US010593450B2

(12) United States Patent
Deligianni et al.

(10) Patent No.: US 10,593,450 B2
(45) Date of Patent: Mar. 17, 2020

(54) MAGNETIC INDUCTOR WITH MULTIPLE MAGNETIC LAYER THICKNESSES

(71) Applicant: International Business Machines Corporation, Armonk, NY (US)

(72) Inventors: Hariklia Deligianni, Alpine, NJ (US); Bruce B. Doris, Slingerlands, NY (US); Eugene J. O'Sullivan, Nyack, NY (US); Naigang Wang, Ossining, NY (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 16/236,795

(22) Filed: Dec. 31, 2018

(65) Prior Publication Data

US 2019/0157000 A1 May 23, 2019

Related U.S. Application Data

(62) Division of application No. 15/473,725, filed on Mar. 30, 2017.

(51) Int. Cl.
*H01F 1/147* (2006.01)
*H01F 17/00* (2006.01)
(Continued)

(52) U.S. Cl.
CPC ..... *H01F 1/14708* (2013.01); *H01F 17/0006* (2013.01); *H01F 17/0013* (2013.01);
(Continued)

(58) Field of Classification Search
CPC .. H01F 41/0206; H01F 27/2823; H01F 27/24; H01F 1/14708
See application file for complete search history.

(56) References Cited

U.S. PATENT DOCUMENTS 5,194,806 A 3/1993 Obama
5,576,099 A 11/1996 Canaperi et al.
(Continued)

FOREIGN PATENT DOCUMENTS

CN 102529211 A 7/2012

OTHER PUBLICATIONS

Deligianni et al., "Stress Management for Thick Magnetic Film Inductors," U.S. Appl. No. 15/599,754, filed May 19, 2017.
(Continued)

*Primary Examiner* — Paul D Kim
(74) *Attorney, Agent, or Firm* — Cantor Colburn LLP; Vazken Alexanian

(57) ABSTRACT

Embodiments are directed to a method of forming a laminated magnetic inductor and resulting structures having multiple magnetic layer thicknesses. A first magnetic stack having one or more magnetic layers alternating with one or more insulating layers is formed in a first inner region of the laminated magnetic inductor. A second magnetic stack is formed opposite a major surface of the first magnetic stack in an outer region of the laminated magnetic inductor. A third magnetic stack is formed opposite a major surface of the second magnetic stack in a second inner region of the laminated magnetic inductor. The magnetic layers are formed such that a thickness of a magnetic layer in each of the first and third magnetic stacks is less than a thickness of a magnetic layer in the second magnetic stack.

19 Claims, 8 Drawing Sheets

(51) Int. Cl.
*H01F 41/04* (2006.01)
*H01F 17/04* (2006.01)
*H01F 41/02* (2006.01)

(52) U.S. Cl.
CPC ..... *H01F 17/04* (2013.01); *H01F 41/0233* (2013.01); *H01F 41/046* (2013.01); *H01F 2017/0053* (2013.01); *H01F 2017/0066* (2013.01)

(56) References Cited

U.S. PATENT DOCUMENTS 5,756,201 A 5/1998 Kadono et al.
5,774,025 A 6/1998 Adam et al.
6,184,143 B1 2/2001 Ohashi et al.
6,346,336 B1 2/2002 Nago
6,377,157 B1 4/2002 Liu et al.
6,504,466 B1 1/2003 Katsurada
6,593,838 B2 7/2003 Yue
6,613,459 B1 9/2003 Saito et al.
6,630,255 B1 10/2003 Litvinov et al.
6,731,460 B2 5/2004 Sasaki
6,759,297 B1 7/2004 Dvorsky et al.
6,943,658 B2 * 9/2005 Gardner ..... H01F 17/0006 257/E21.022
6,982,196 B2 1/2006 Belyansky et al.
7,202,516 B2 4/2007 Belyansky et al.
7,238,990 B2 7/2007 Burnett et al.
7,380,328 B2 6/2008 Ahn et al.
7,488,659 B2 2/2009 Dyer
7,737,052 B2 6/2010 Bhatia et al.
7,755,124 B2 7/2010 Fajardo et al.
7,791,837 B2 9/2010 Fujiwara
7,847,668 B2 12/2010 Lai et al.
7,906,383 B2 3/2011 Richter et al.
7,936,246 B2 5/2011 Hopper et al.
7,982,286 B2 7/2011 Rossi et al.
8,044,755 B2 10/2011 Smeys et al.
8,049,993 B2 11/2011 Shirotori et al.
8,093,981 B2 1/2012 Chung
8,278,164 B2 10/2012 Li et al.
8,299,615 B2 10/2012 Fayaz et al.
8,308,964 B2 11/2012 Xu et al.
8,314,676 B1 11/2012 Smeys et al.
8,323,728 B2 12/2012 Iorio et al.
8,354,694 B2 1/2013 Bedell et al.
8,466,537 B1 6/2013 Papou et al.
8,587,400 B2 11/2013 Nakajima et al.
8,691,696 B2 4/2014 Cai et al.
8,698,328 B2 4/2014 Nair et al.
8,704,627 B2 4/2014 Kuroda
8,717,136 B2 5/2014 Fontana, Jr. et al.
8,736,413 B2 5/2014 Yokoyama et al.
9,047,890 B1 6/2015 Herget
9,153,547 B2 10/2015 Crawford et al.
9,231,072 B2 1/2016 Alptekin
9,324,495 B2 4/2016 Fontana, Jr. et al.
9,356,121 B2 5/2016 Jagannathan
9,412,866 B2 8/2016 Kuoh et al.
9,437,668 B1 9/2016 Deligianni et al.
9,697,948 B2 7/2017 Osada et al.
9,799,519 B1 10/2017 Joseph
2001/0050607 A1 12/2001 Gardner
2003/0077871 A1 4/2003 Cheng et al.
2004/0219328 A1 11/2004 Tasaki et al.
2006/0222821 A1 10/2006 Masai
2007/0030659 A1 2/2007 Suzuki et al.
2008/0036536 A1 2/2008 Khorramabadi
2008/0284552 A1 11/2008 Lim et al.
2011/0050607 A1 3/2011 Park
2011/0133880 A1 6/2011 Pitts et al.
2011/0172111 A1 7/2011 Cantor et al.
2012/0233849 A1 9/2012 Smeys et al.
2012/0236528 A1 9/2012 Le et al.
2012/0319236 A1 12/2012 Chen et al.
2013/0056847 A1 3/2013 Chen
2013/0106552 A1 5/2013 Fontana, Jr. et al.
2013/0224887 A1 8/2013 Lee et al.
2014/0027880 A1 1/2014 Duevel et al.
2014/0062646 A1 * 3/2014 Morrissey ..... H01F 27/24 336/233
2014/0068932 A1 3/2014 Sturcken
2014/0216939 A1 8/2014 Fontana, Jr. et al.
2014/0349414 A1 11/2014 Zhong et al.
2015/0109088 A1 4/2015 Kim et al.
2015/0115404 A1 4/2015 Hsueh et al.
2015/0171157 A1 6/2015 Sturcken et al.
2015/0187772 A1 7/2015 Choi et al.
2015/0338474 A1 * 11/2015 Mohan ..... G01R 33/04 257/425
2015/0340149 A1 11/2015 Lee et al.
2016/0086960 A1 3/2016 Wen et al.
2016/0260708 A1 9/2016 Herget et al.
2017/0179154 A1 6/2017 Furihata
2017/0250134 A1 8/2017 Sturcken et al.
2018/0005741 A1 1/2018 Doris et al.
2018/0294094 A1 * 10/2018 Deligianni ..... H01F 17/0013
2018/0308612 A1 * 10/2018 Park ..... H01F 1/147

OTHER PUBLICATIONS

Deligianni et al., "Stress Management for Thick Magnetic Film Inductors," U.S. Appl. No. 16/107,102, filed Aug. 21, 2018.
Deligianni et al., "Laminated Magnetic Inductor Stack With High Frequency Peak Quality Factor", U.S. Appl. No. 15/479,615, filed Apr. 5, 2017.
Deligianni et al., "Magnetic Inductor Stack Including Insulating Material Having Multiple Thicknesses," U.S. Appl. No. 15/584,766, filed May 2, 2017.
Deligianni et al., "Magnetic Inductor Stack Including Magnetic Materials Having Multiple Permeabilities," U.S. Appl. No. 15/494,871, filed Apr. 24, 2017.
Deligianni et al., "Magnetic Inductor Stack Including Magnetic Materials Having Multiple Permeabilities," U.S. Appl. No. 15/966,202, filed Apr. 30, 2018.
Deligianni et al., "Magnetic Inductor Stacks," U.S. Appl. No. 15/403,292, filed Jan. 11, 2017.
Deligianni et al., "Magnetic Inductor Stacks," U.S. Appl. No. 15/800,702, filed Nov. 1, 2017.
Deligianni et al., "Magnetic Inductor With Multiple Magnetic Layer Thicknesses," U.S. Appl. No. 15/473,725, filed Mar. 30, 2017.
Deligianni et al., "Magnetic Inductor With Shape Anisotrophy", U.S. Appl. No. 15/476,147, filed Mar. 31, 2017.
List of IBM Patents or Patent Applications Treated as Related; (Appendix P), Date Filed Jan. 23, 2019; 2 pages.
Deligianni et al., "Stress Management for Thick Magnetic Film Inductors," U.S. Appl. No. 16/391,383, filed Apr. 23, 2019.
E. Quandt et al., "Magnetostrictive LC circuit sensors," Materials Transactions, vol. 45, No. 2, 2004, pp. 244-248.
Gao, "Significantly Enhanced Inductance and Quality Factor of GHz Integrated Magnetic Solenoid Inductors With FeGaB/A12O3 Multilayer Films", IEEE Transactions on Electron Devices, vol. 61, No. 5, May 2014, pp. 1470-1476, IEEE.
Iakubov et al., "Control over magnetic spectrum of multilayer magnetic film metamaterial," AIP Advances, vol. 5, No. 7, 2015, 077116, 7 pages.
List of IBM Patents or Patent Applications Treated as Related; Date Filed: Aug. 2, 2019, 2 pages.

* cited by examiner

MAGNETIC INDUCTOR WITH MULTIPLE MAGNETIC LAYER THICKNESSES

DOMESTIC PRIORITY

This application is a divisional of U.S. patent application Ser. No. 15/473,725, filed Mar. 30, 2017, now pending, the disclosure of which is incorporated by reference herein in its entirety.

BACKGROUND

The present invention generally relates to fabrication methods and resulting structures for semiconductor devices. More specifically, the present invention relates to a laminated magnetic inductor having multiple magnetic layer thicknesses.

Inductors, resistors, and capacitors are the main passive elements constituting an electronic circuit. Inductors are used in circuits for a variety of purposes, such as in noise reduction, inductor-capacitor (LC) resonance calculators, and power supply circuitry. Inductors can be classified as one of various types, such as a winding-type inductor or a laminated film-type inductor. Winding-type inductors are manufactured by winding a coil around, or printing a coil on, a ferrite core. Laminated film-type inductors are manufactured by stacking alternating magnetic or dielectric materials to form laminated stacks.

Among the various types of inductors the laminated film-type inductor is widely used in power supply circuits requiring miniaturization and high current due to the reduced size and improved inductance per coil turn of these inductors relative to other inductor types. A general laminated inductor includes one or more magnetic or dielectric layers laminated with conductive patterns. The conductive patterns are sequentially connected by a conductive via formed in each of the layers and overlapped in a laminated direction to form a spiral-structured coil. Typically, both ends of the coil are drawn out to an outer surface of a laminated body for connection to external terminals.

SUMMARY

Embodiments of the present invention are directed to a method for fabricating a laminated magnetic inductor. A non-limiting example of the method includes forming a first magnetic stack having one or more magnetic layers alternating with one or more insulating layers in a first inner region of the laminated magnetic inductor. A second magnetic stack is formed opposite a major surface of the first magnetic stack in an outer region of the laminated magnetic inductor. A third magnetic stack is formed opposite a major surface of the second magnetic stack in a second inner region of the laminated magnetic inductor. The magnetic layers are formed such that a thickness of a magnetic layer in each of the first and third magnetic stacks is less than a thickness of a magnetic layer in the second magnetic stack.

Embodiments of the present invention are directed to a laminated magnetic inductor. A non-limiting example of the laminated magnetic inductor includes a first inner region having one or more magnetic layers alternating with one or more insulating layers. An outer region having one or more magnetic layers alternating with one or more insulating layers is formed opposite a major surface of the first inner region. A second inner region having one or more magnetic layers alternating with one or more insulating layers is formed opposite a major surface of the outer region. The magnetic layers are formed such that a thickness of a magnetic layer in each of the first and second inner regions is less than a thickness of a magnetic layer in the outer region.

Embodiments of the present invention are directed to a laminated magnetic inductor. A non-limiting example of the laminated magnetic inductor includes a substrate and a first dielectric layer formed opposite a major surface of the substrate. A laminated stack is formed opposite a major surface of the first dielectric layer. The laminated stack includes an inner region adjacent to the first dielectric layer and an outer region formed opposite a major surface of the inner region. A second dielectric layer is formed opposite a major surface of the laminated stack. A conductive coil helically wraps through the first and second dielectric layers. The magnetic layers are formed such that a thickness of a magnetic layer in the inner region is less than a thickness of a magnetic layer in the outer region.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The specifics of the exclusive rights described herein are particularly pointed out and distinctly claimed in the claims at the conclusion of the specification.

The foregoing and other features and advantages of the embodiments of the invention are apparent from the following detailed description taken in conjunction with the accompanying drawings in which.

Figure 1:
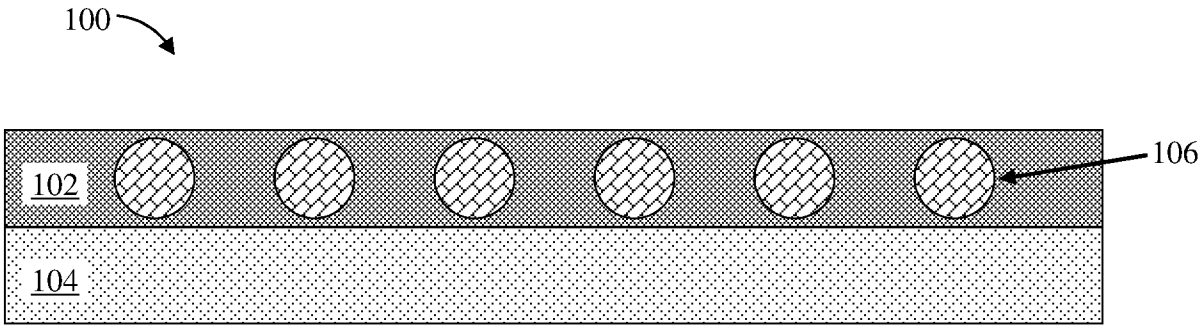
FIG. 1 depicts a laminated magnetic inductor after a fabrication operation according to embodiments of the invention.

The diagrams depicted herein are illustrative. There can be many variations to the diagram or the operations described therein without departing from the spirit of the invention. For instance, the actions can be performed in a differing order or actions can be added, deleted or modified.

In the accompanying figures and following detailed description of the disclosed embodiments, the various elements illustrated in the figures are provided with two or three digit reference numbers. With minor exceptions, the leftmost digit(s) of each reference number correspond to the figure in which its element is first illustrated.

DETAILED DESCRIPTION

For the sake of brevity, conventional techniques related to semiconductor device and integrated circuit (IC) fabrication may or may not be described in detail herein. Moreover, the various tasks and process steps described herein can be incorporated into a more comprehensive procedure or process having additional steps or functionality not described in detail herein. In particular, various steps in the manufacture of laminated inductor devices are well known and so, in the interest of brevity, many conventional steps will only be mentioned briefly herein or will be omitted entirely without providing the well-known process details.

Turning now to an overview of technologies that are more specifically relevant to aspects of the invention, as previously noted herein, laminated film-type inductors offer reduced size and improved inductance per coil turn relative to other inductor types. For this reason, laminated film-type inductors are widely used in applications requiring miniaturization and high current, such as power supply circuitry. The integration of inductive power converters onto silicon is one path to reducing the cost, weight, and size of electronic devices.

Laminated film-type inductor performance can be improved by adding layers of magnetic film. There are two basic laminated film-type magnetic inductor configurations: the closed yoke type laminated inductor and the solenoid type laminated inductor. The closed yoke type laminated inductor includes a metal core (typically a copper wire) and magnetic material wrapped around the core. Conversely, the solenoid type laminated inductor includes a magnetic material core and a conductive wire (e.g., copper wire) wrapped around the magnetic material. Both the closed yoke type laminated inductor and the solenoid type laminated inductor benefit by having very thick magnetic stacks or yokes (e.g., magnetic layers having a thickness of greater than about 200 nm). Thick magnetic layers offer faster throughput and are significantly more efficient to deposit. There are challenges, however, in providing laminated film-type inductor architectures having thick magnetic layers.

One such challenge is addressing the increased loss in energy due to the powerful eddy currents associated with inductors having thick magnetic films. Eddy currents (also known as Foucault currents) are loops of electrical current induced by a changing magnetic field in a conductor. Eddy currents flow in closed loops within conductors in a plane perpendicular to the magnetic field. Eddy currents are created when the time varying magnetic fields in the magnetic layers create an electric field that drives a circular current flow. These losses can be substantial and increase with the thickness of the magnetic layers. As magnetic film thicknesses increase, the eddy currents become severe enough to degrade the quality factor (also known as "Q") of the inductor. The quality factor of an inductor is the ratio of its inductive reactance to its resistance at a given frequency, and is a measure of its efficiency. The maximum attainable quality factor for a given inductor across all frequencies is known as peak Q (or maximum Q). Some applications can require the peak Q to be at a low frequency and other applications can require the peak Q to be at a high frequency.

The magnetic loss caused by eddy currents in a thick film inductor is largest in the region of the inductor where the coil is in close proximity to the magnetic material. Specifically, magnetic layers closer to the coil (that is, the "inner layers") have larger losses than magnetic layers further from the coil (the "outer layers"). Moreover, magnetic flux densities in the space occupied by inner layers are generally higher than those characterizing the outer layers due to the magnetic reluctance of the insulating layers (also called spacer layers) interposed between the winding and the outer layers. Due to these relatively large magnetic flux densities in the space occupied by the inner layers, the inner layers tend to magnetically saturate at lower drive currents and have greater losses than the outer layers. Accordingly, the inner layer region is a critical region—the losses in this critical region dominate the overall losses of the inductor. Consequently, if losses can be mitigated or controlled in this critical region the overall performance (i.e., quality factor) of the inductor can be improved.

Turning now to an overview of the aspects of the invention, one or more embodiments of the invention address the above-described shortcomings by providing methods of fabricating a laminated magnetic inductor having multiple magnetic layer thicknesses. A laminated stack having a first inner region, an outer region, and a second inner region is formed opposite a major surface of a substrate. Magnetic layers in the first and second inner regions of the laminated stack are closer (more proximate to) a coil, whereas magnetic layers in the outer region are relatively distant from a coil. The laminated stack is structured such that magnetic layers in the first and second inner regions are thin (e.g., having a thickness of less than about 100 nm), while magnetic layers in the outer region are thick (e.g., having a thickness of greater than about 200 nm). In this manner, eddy current losses can be controlled in critical regions (i.e., the first and second inner regions) while providing improved throughput in noncritical regions (i.e., the outer region). Varying the thicknesses of the magnetic layers in this way advantageously provides a more uniform magnetic flux density while also improving the quality factor of the laminated magnetic inductor.

Turning now to a more detailed description of aspects of the present invention, FIG. 1 depicts a cross-sectional view of a structure 100 having a dielectric layer 102 formed opposite a major surface of a substrate 104 during an intermediate operation of a method of fabricating a semiconductor device according to embodiments of the invention. The dielectric layer 102 can be any suitable material, such as, for example, a low-k dielectric, silicon dioxide ($SiO_2$), silicon oxynitride (SiON), and silicon oxycarbonitride (SiOCN). Any known manner of forming the dielectric layer 102 can be utilized. In some embodiments, the dielectric layer 102 is $SiO_2$ conformally formed on exposed surfaces of the substrate 104 using a conformal deposition process such as PVD, CVD, plasma-enhanced CVD (PECVD), or a combination thereof. In some embodiments, the dielectric layer 102 is conformally formed to a thickness of about 50 nm to about 400 nm, although other thicknesses are within the contemplated scope of embodiments of the invention.

The substrate 104 can be a wafer and can have undergone known semiconductor front end of line processing (FEOL), middle of the line processing (MOL), and back end of the line processing (BEOL). FEOL processes can include, for example, wafer preparation, isolation, well formation, gate patterning, spacer, extension and source/drain implantation, and silicide formation. The MOL can include, for example, gate contact formation, which can be an increasingly challenging part of the whole fabrication flow, particularly for lithography patterning. In the BEOL, interconnects can be fabricated with, for example, a dual damascene process using plasma-enhanced CVD (PECVD) deposited interlayer dielectric (ILDs), PVD metal barriers, and electrochemically plated conductive wire materials. The substrate 104 can include a bulk silicon substrate or a silicon on insulator (SOI) wafer. The substrate 104 can be made of any suitable material, such as, for example, Ge, SiGe, GaAs, InP, AlGaAs, or InGaAs.

A conductive coil 106 is helically wound through the dielectric layer 102. For ease of discussion reference is made to operations performed on and to a conductive coil 106 having six turns or windings formed in the dielectric layer 102 (e.g., the conductive coil 106 wraps around the dielectric layer 102 and other portions of the structure 100 a total of six times). It is understood, however, that the dielectric layer 102 can include any number of windings. For example, the dielectric layer 102 can include a single winding, 2 windings, 5 windings, 10 windings, or 20 windings, although other winding counts are within the contemplated scope of embodiments of the invention. The conductive coil 106 can be made of any suitable conducting material, such as, for example, metal (e.g., tungsten, titanium, tantalum, ruthenium, zirconium, cobalt, copper, aluminum, lead, platinum, tin, silver, gold), conducting metallic compound material (e.g., tantalum nitride, titanium nitride, tantalum carbide, titanium carbide, titanium aluminum carbide, tungsten silicide, tungsten nitride, ruthenium oxide, cobalt silicide, nickel silicide), carbon nanotube, conductive carbon, graphene, or any suitable combination of these materials.

Figure 2:
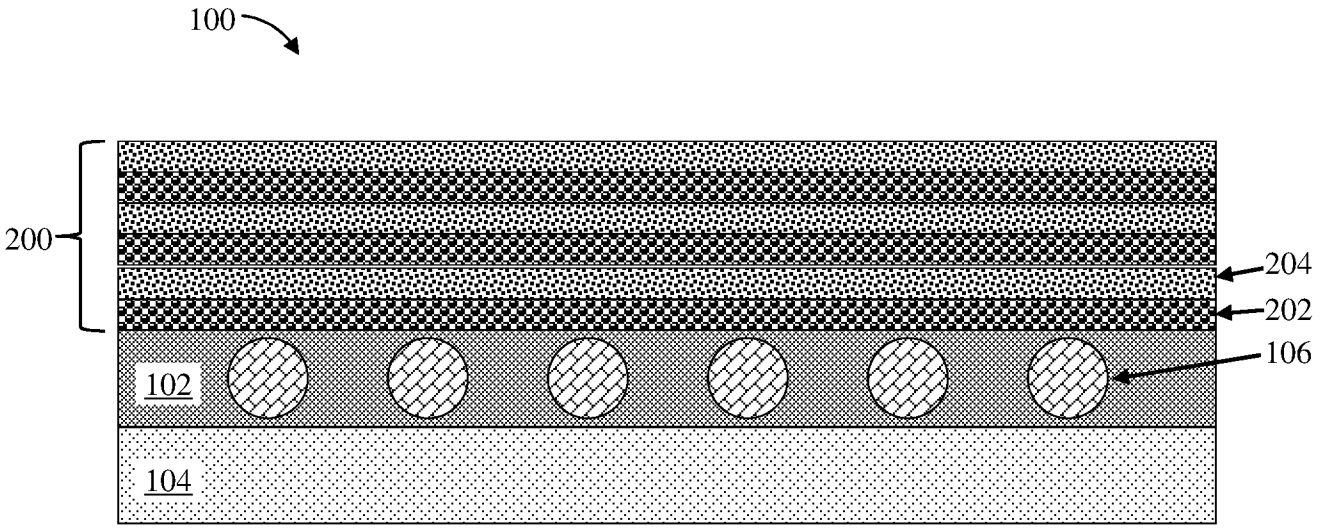
FIG. 2 depicts a laminated magnetic inductor after a fabrication operation according to embodiments of the invention.

FIG. 2 depicts a cross-sectional view of the structure 100 after forming a first inner layer region 200 opposite a major surface of the dielectric layer 102 during an intermediate operation of a method of fabricating a semiconductor device according to embodiments of the invention. The first inner layer region 200 includes one or more inner magnetic layers (e.g., inner magnetic layer 202) alternating with one or more insulating layers (e.g., insulating layer 204). The first inner layer region 200 is formed by depositing alternating magnetic and insulating layers. For ease of discussion the first inner layer region 200 is depicted as having three inner magnetic layers alternating with three insulating layers. It is understood, however, that the first inner layer region 200 can include any number of inner magnetic layers alternating with a corresponding number of insulating layers. For example, the first inner layer region 200 can include a single inner magnetic layer, two inner magnetic layers, five inner magnetic layers, eight inner magnetic layers, or any number of inner magnetic layers, along with a corresponding number of insulating layers (i.e., as appropriate to form an inner layer region having a topmost insulating layer on a topmost inner magnetic layer and an insulating layer between each pair of adjacent inner magnetic layers).

The inner magnetic layer 202 can be made of any suitable magnetic material known in the art, such as, for example, a ferromagnetic material, soft magnetic material, iron alloy, nickel alloy, cobalt alloy, ferrites, plated materials such as permalloy, or any suitable combination of these materials. In some embodiments, the inner magnetic layer 202 includes a Co containing magnetic material, FeTaN, FeNi, FeAlO, or combinations thereof. Any known manner of forming the inner magnetic layer 202 can be utilized. The inner magnetic layer 202 can be deposited through vacuum deposition technologies (i.e., sputtering) or electrodepositing through an aqueous solution. In some embodiments, the inner magnetic layer 202 is conformally formed on exposed surfaces of the dielectric layer 102 using a conformal deposition process such as PVD, CVD, PECVD, or a combination thereof. Only thin magnetic layers (i.e., layers having a thickness of less than about 100 nm) are formed in the first inner layer region 200. In this manner, losses in the first inner layer region 200 are well-controlled. In some embodiments, the inner magnetic layer 202 is conformally formed to a thickness of about 5 nm to about 100 nm, although other thicknesses are within the contemplated scope of embodiments of the invention.

The insulating layer 204 serves to isolate the adjacent magnetic material layers from each other in the stack and can be made of any suitable non-magnetic insulating material known in the art, such as, for example, aluminum oxides (e.g., alumina), silicon oxides (e.g., $SiO_2$), silicon nitrides, silicon oxynitrides ($SiO_xN_y$), polymers, magnesium oxide (MgO), or any suitable combination of these materials. Any known manner of forming the insulating layer 204 can be utilized. In some embodiments, the insulating layer 204 is conformally formed on exposed surfaces of the inner magnetic layer 202 using a conformal deposition process such as PVD, CVD, PECVD, or a combination thereof. The insulating layer 204 can be about one half or greater of the thickness of the inner magnetic layer 202. In some embodiments, the insulating layer 204 is conformally formed to a thickness of about 5 nm to about 10 nm, although other thicknesses are within the contemplated scope of embodiments of the invention.

Figure 3:
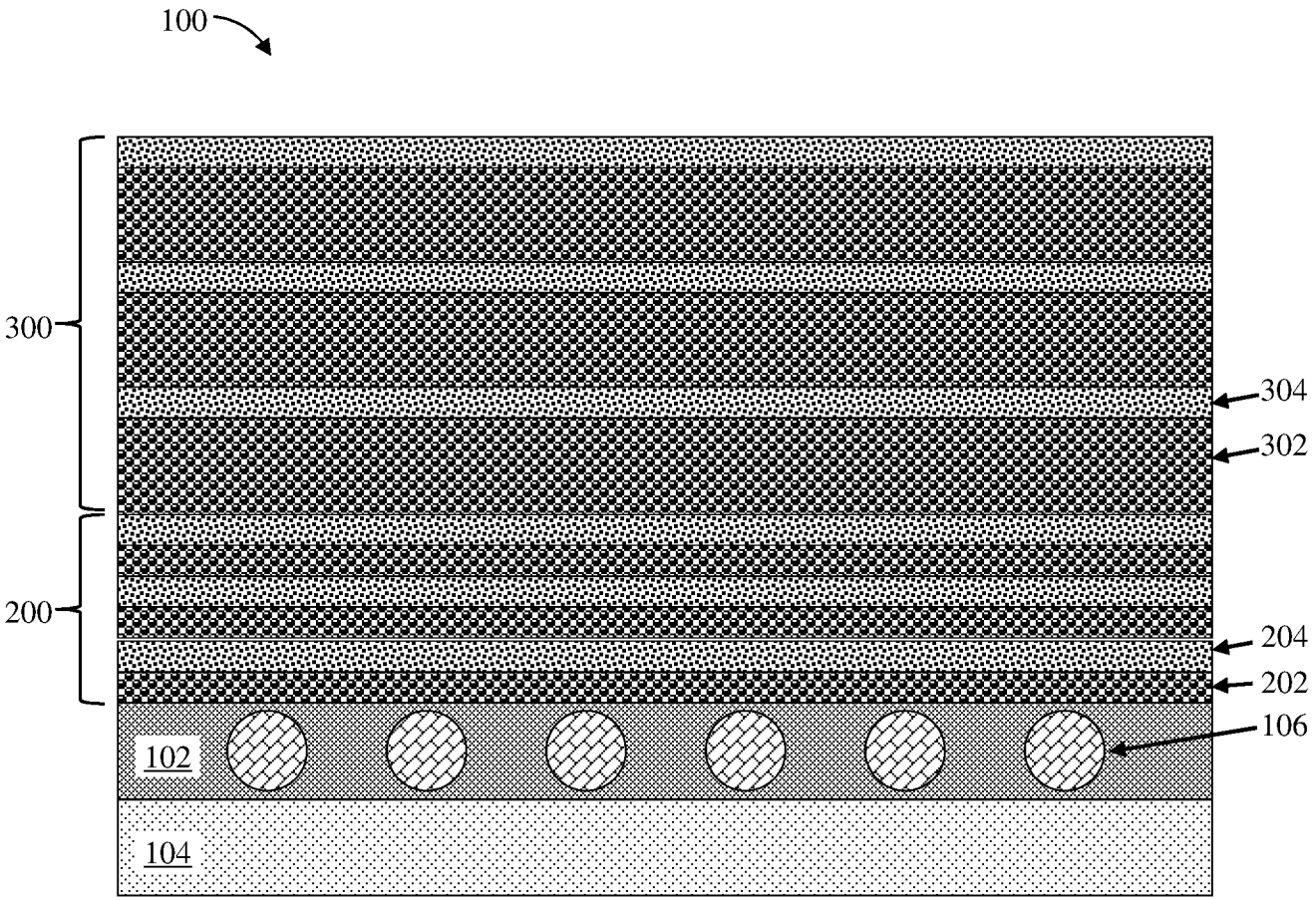
FIG. 3 depicts a laminated magnetic inductor after a fabrication operation according to embodiments of the invention.

FIG. 3 depicts a cross-sectional view of the structure 100 after forming an outer layer region 300 opposite a major surface of the first inner layer region 200 during an intermediate operation of a method of fabricating a semiconductor device according to embodiments of the invention. The outer layer region 300 includes one or more outer magnetic layers (e.g., outer magnetic layer 302) alternating with one or more insulating layers (e.g., insulating layer 304). The outer layer region 300 is formed in a similar manner as the first inner layer region 200—by depositing alternating magnetic and insulating layers. For ease of discussion the outer layer region 300 is depicted as having three outer magnetic layers alternating with three insulating layers. It is understood, however, that the outer layer region 300 can include any number of outer magnetic layers alternating with a corresponding number of insulating layers. For example, the outer layer region 300 can include a single outer magnetic layer, two outer magnetic layers, five outer magnetic layers, eight outer magnetic layers, or any number of outer magnetic layers, along with a corresponding number of insulating layers (i.e., as appropriate to form an outer layer region having a topmost insulating layer on a topmost outer magnetic layer and an insulating layer between each pair of adjacent outer magnetic layers). It is further understood that the outer layer region 300 can include a different number of magnetic layers than the first inner layer region 200.

The outer magnetic layer 302 can be made of any suitable magnetic material known in the art, such as, for example, a ferromagnetic material, soft magnetic material, iron alloy, nickel alloy, cobalt alloy, ferrites, plated materials such as permalloy, or any suitable combination of these materials. Any known manner of forming the outer magnetic layer 302 can be utilized. In some embodiments, the outer magnetic layer 302 is conformally formed on exposed surfaces of the first inner layer region 200 using a conformal deposition process such as PVD, CVD, PECVD, or a combination thereof.

As discussed previously herein, the outer layer region 300 is less critical to the overall quality factor of the inductor and thick magnetic layers (i.e., layers having a thickness of more than about 200 nm) can be formed in the outer layer region 300 with only minimal efficiency losses. Consequently, the outer magnetic layer 302 can be conformally formed to a thickness much greater than the inner magnetic layer 202. In some embodiments, the outer magnetic layer 302 is conformally formed to a thickness of about 200 nm to about 800 nm, although other thicknesses are within the contemplated scope of embodiments of the invention. In this manner, throughput of the structure 100 can be improved.

The insulating layer 304 can be made of any suitable non-magnetic insulating material known in the art, such as, for example, aluminum oxides (for example, alumina), silicon oxides, silicon nitrides, polymers, or any suitable combination of these materials. Any known manner of forming the insulating layer 304 can be utilized. In some embodiments, the insulating layer 304 is conformally formed on exposed surfaces of the outer magnetic layer 302 using a conformal deposition process such as PVD, CVD, PECVD, or a combination thereof. In some embodiments, the insulating layer 304 is conformally formed to a thickness of about 5 nm to about 10 nm, although other thicknesses are within the contemplated scope of embodiments of the invention. The insulating layer 304 can have a same thickness, a larger thickness, or a smaller thickness as the insulating layer 204 in the first inner layer region 200.

Figure 4:
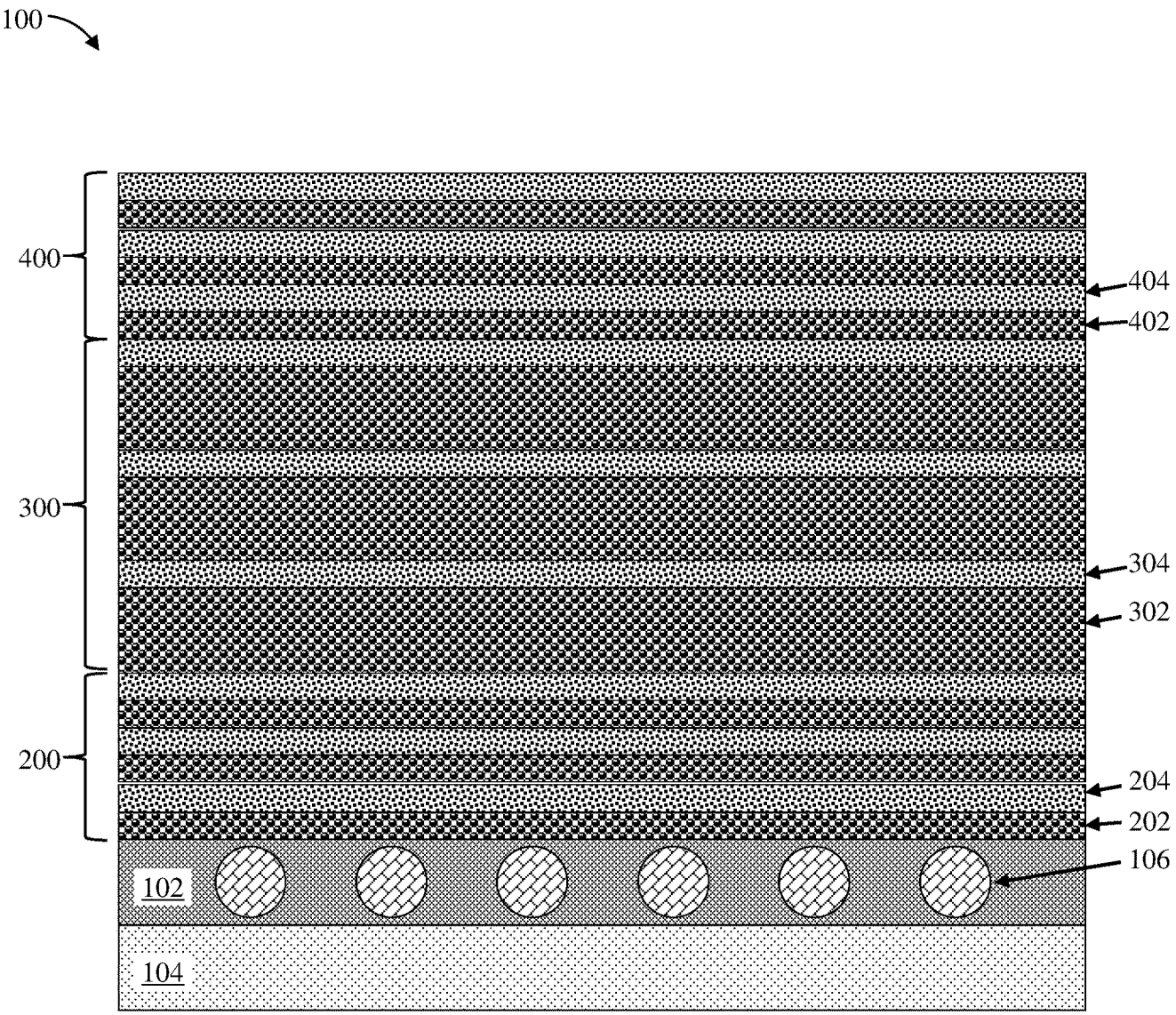
FIG. 4 depicts a laminated magnetic inductor after a fabrication operation according to embodiments of the invention.

FIG. 4 depicts a cross-sectional view of the structure 100 after forming a second inner layer region 400 opposite a major surface of the outer layer region 300 during an intermediate operation of a method of fabricating a semiconductor device according to embodiments of the invention. The second inner layer region 400 includes one or more inner magnetic layers (e.g., inner magnetic layer 402) alternating with one or more insulating layers (e.g., insulating layer 404). The second inner layer region 400 is formed in a similar manner as the first inner layer region 200. For ease of discussion the second inner layer region 400 is depicted as having three inner magnetic layers alternating with three insulating layers. It is understood, however, that the second inner layer region 400 can include any number of inner magnetic layers alternating with a corresponding number of insulating layers. For example, the second inner layer region 400 can include a single inner magnetic layer, two inner magnetic layers, five inner magnetic layers, eight inner magnetic layers, or any number of inner magnetic layers, along with a corresponding number of insulating layers (i.e., as appropriate to form an inner layer region having a topmost insulating layer on a topmost inner magnetic layer and an insulating layer between each pair of adjacent inner magnetic layers).

The inner magnetic layer 402 can be made of any suitable magnetic material and can be formed using any suitable process in a similar manner as the inner magnetic layer 202. In some embodiments, the inner magnetic layer 402 is conformally formed to a thickness of about 5 nm to about 100 nm, although other thicknesses are within the contemplated scope of embodiments of the invention. The inner magnetic layer 402 can have a same thickness, a larger thickness, or a smaller thickness as the inner magnetic layer 202 in the first inner layer region 200. Only thin magnetic layers (i.e., layers having a thickness of less than about 100 nm) are formed in the second inner layer region 400. In this manner, losses in the second inner layer region 400 are well-controlled.

The insulating layer 404 can be made of any suitable non-magnetic insulating material and can be formed using any suitable process in a similar manner as the insulating layer 204. In some embodiments, the insulating layer 404 is conformally formed to a thickness of about 5 nm to about 10 nm, although other thicknesses are within the contemplated scope of embodiments of the invention. The insulating layer 404 can have a same thickness, a larger thickness, or a smaller thickness as the insulating layer 204 in the first inner layer region 200.

Figure 5:
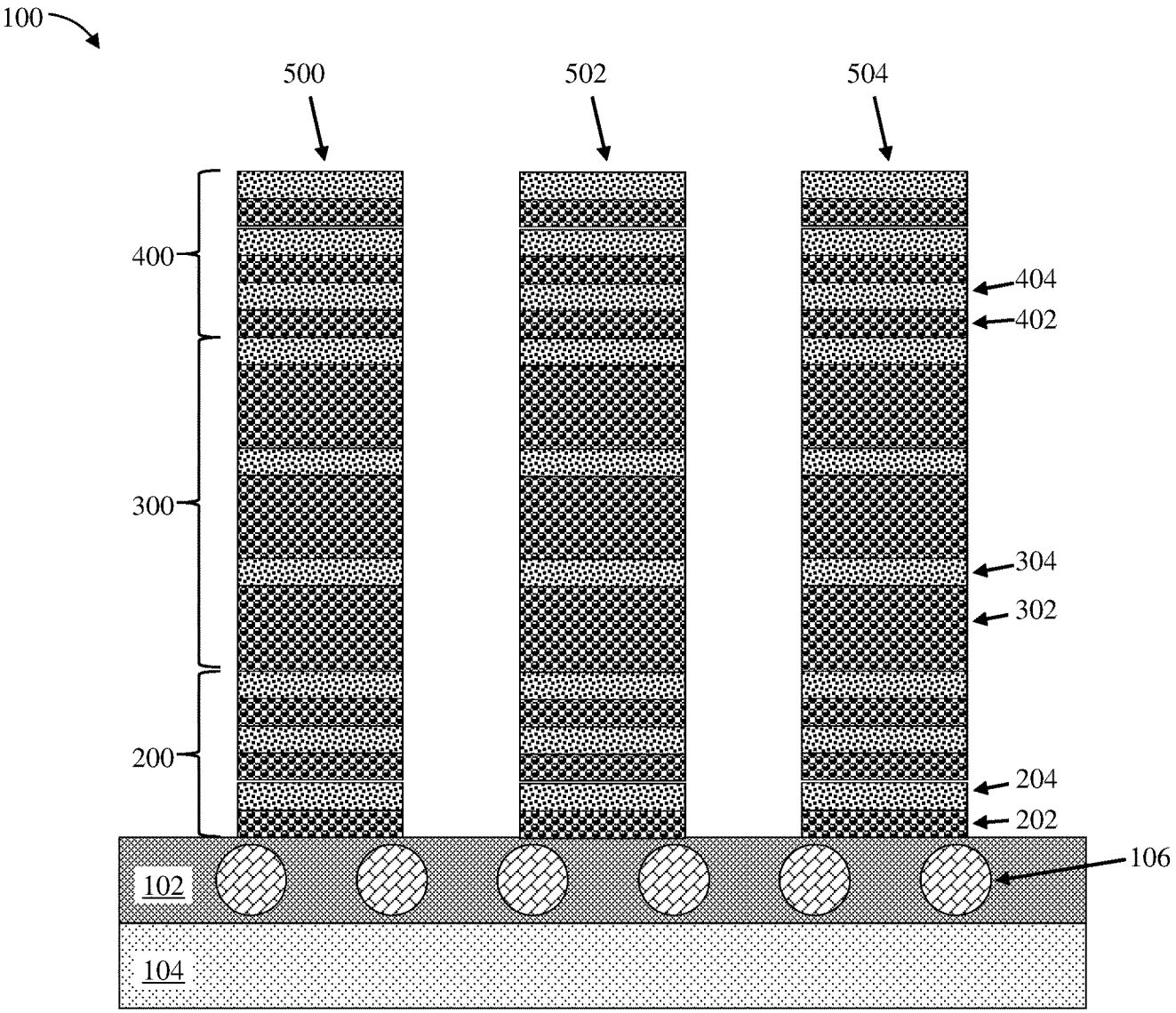
FIG. 5 depicts a laminated magnetic inductor after a fabrication operation according to embodiments of the invention.

FIG. 5 depicts a cross-sectional view of the structure 100 after patterning the first inner layer region 200, the outer layer region 300, and the second inner layer region 400 to form laminated stacks 500, 502, and 504 during an intermediate operation of a method of fabricating a semiconductor device according to embodiments of the invention. Any known method for patterning laminated stacks can be used, such as, for example, a wet etch, a dry etch, or a combination of sequential wet and/or dry etches. In some embodiments, the laminated stacks 500, 502, and 504 are formed by removing portions of the first inner layer region 200, the outer layer region 300, and the second inner layer region 400 selective to the dielectric layer 102. For ease of discussion the structure 100 is depicted as having three laminated stacks (e.g., the laminated stacks 500, 502, and 504). It is understood, however, that the structure 100 can include any number of laminated stacks. For example, the structure 100 can include a single laminated stack, two laminated stacks, five laminated stacks, eight laminated stacks, or any number of laminated stacks.

Figure 6:
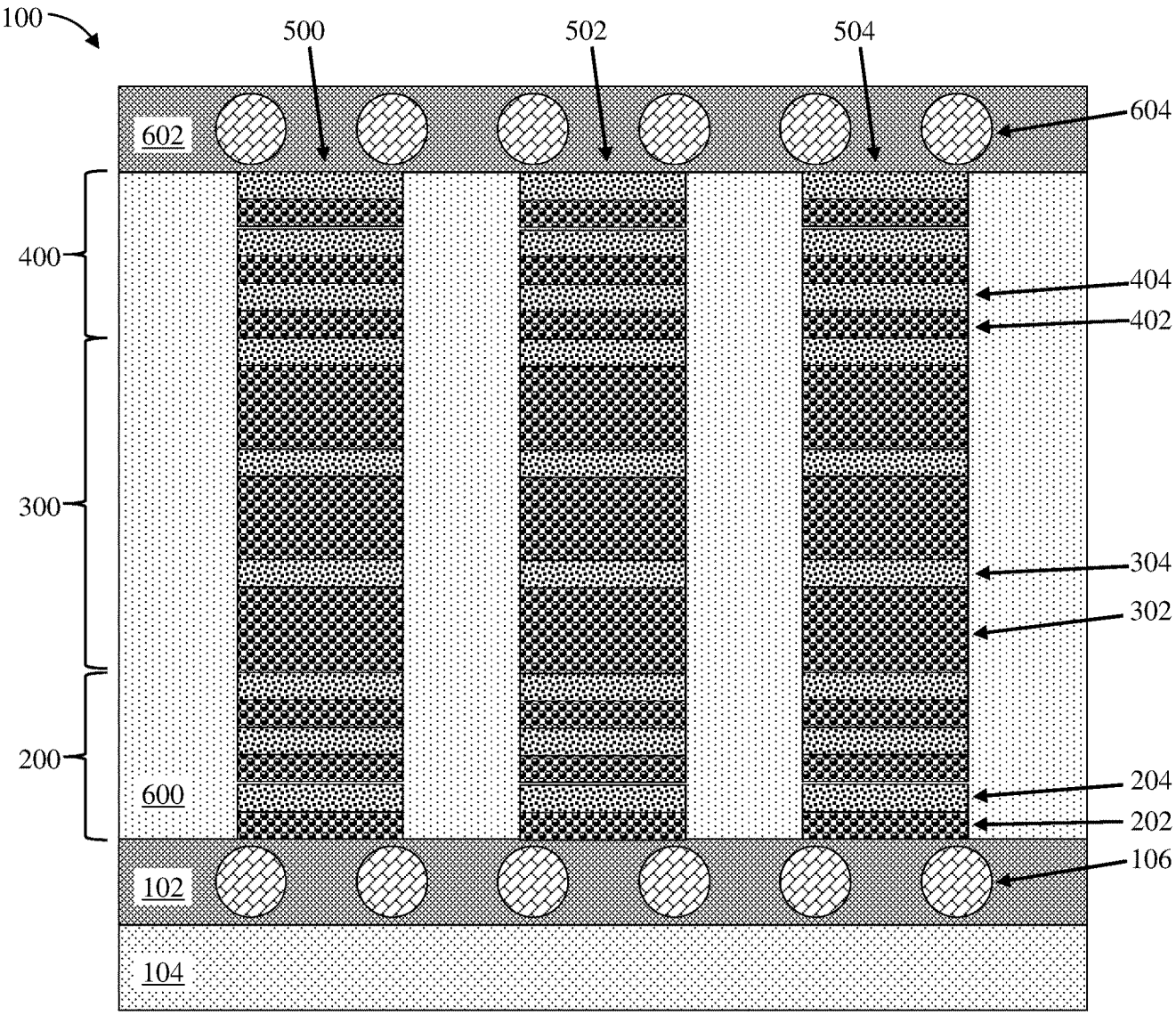
FIG. 6 depicts a laminated magnetic inductor after a fabrication operation according to embodiments of the invention.

FIG. 6 depicts a cross-sectional view of the structure 100 after forming a dielectric layer 600 opposite a major surface of the dielectric layer 102 during an intermediate operation of a method of fabricating a semiconductor device according to embodiments of the invention. The dielectric layer 600 can be any suitable insulating material, such as, for example, a low-k dielectric, $SiO_2$, SiON, and SiOCN. Any known manner of forming the dielectric layer 600 can be utilized. In some embodiments, the dielectric layer 600 is $SiO_2$ conformally formed opposite a major surface of the dielectric layer 102 using a conformal deposition process such as PVD, CVD, PECVD, or a combination thereof. In some embodiments, the dielectric layer 600 is conformally formed to a thickness sufficient to cover a major surface of the laminated stacks 500, 502, and 504. In some embodiments, a CMP selective to the laminated stacks 500, 502, and 504 planarizes the dielectric layer 600 to a major surface of the laminated stacks 500, 502, and 504.

A dielectric layer 602 is formed opposite a major surface of the dielectric layer 600. The dielectric layer 602 can be any suitable material, such as, for example, a low-k dielectric, $SiO_2$, SiON, and SiOCN. Any known manner of forming the dielectric layer 602 can be utilized. In some embodiments, the dielectric layer 602 is $SiO_2$ conformally formed opposite a major surface of the dielectric layer 600 using a conformal deposition process such as PVD, CVD, PECVD, or a combination thereof. In some embodiments, the dielectric layer 602 is conformally formed to a thickness of about 50 nm to about 400 nm, although other thicknesses are within the contemplated scope of embodiments of the invention.

One or more coils 604 are formed in the dielectric layer 602, in a similar manner as the coils 106 formed in the dielectric layer 102. For ease of discussion reference is made to operations performed on and to a structure 100 having six coils (e.g., the coils 604) formed in the dielectric layer 602. It is understood, however, that the dielectric layer 602 can include any number of coils. For example, the dielectric layer 602 can include a single coil, 2 coils, 5 coils, 10 coils, or 20 coils, although other coil counts are within the contemplated scope of embodiments of the invention. The coils 602 can be made of any suitable conducting material, such as, for example, metal (e.g., tungsten, titanium, tantalum, ruthenium, zirconium, cobalt, copper, aluminum, lead, platinum, tin, silver, gold), conducting metallic compound material (e.g., tantalum nitride, titanium nitride, tantalum carbide, titanium carbide, titanium aluminum carbide, tungsten silicide, tungsten nitride, ruthenium oxide, cobalt silicide, nickel silicide), carbon nanotube, conductive carbon, graphene, or any suitable combination of these materials. The dielectric layer 602 can include the same, more, or less coils than the dielectric layer 102.

Figure 7:
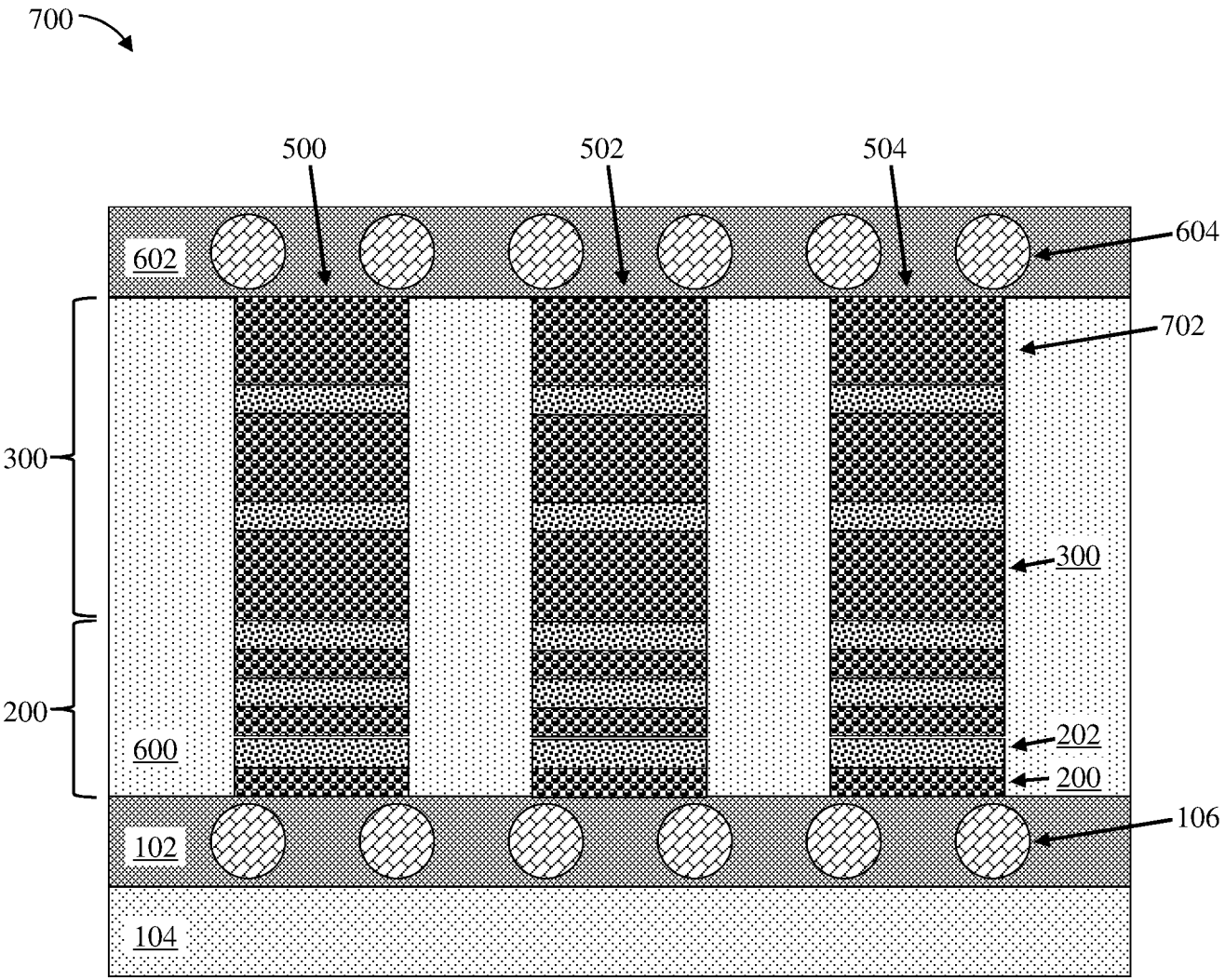
FIG. 7 depicts a laminated magnetic inductor after a fabrication operation according to embodiments of the invention.

FIG. 7 depicts a cross-sectional view of a structure 700 having a first inner layer region 200 and an outer layer region 300 formed during an intermediate operation of a method of fabricating a semiconductor device according to embodiments of the invention. The structure 700 is formed in a similar manner as the structure 100, except that the structure 700 omits the second inner layer region 400 (as depicted in FIG. 6). In some embodiments, the dielectric layer 602 is formed opposite a major surface of a topmost outer magnetic layer 702 of the outer layer region 300.

Figure 8:
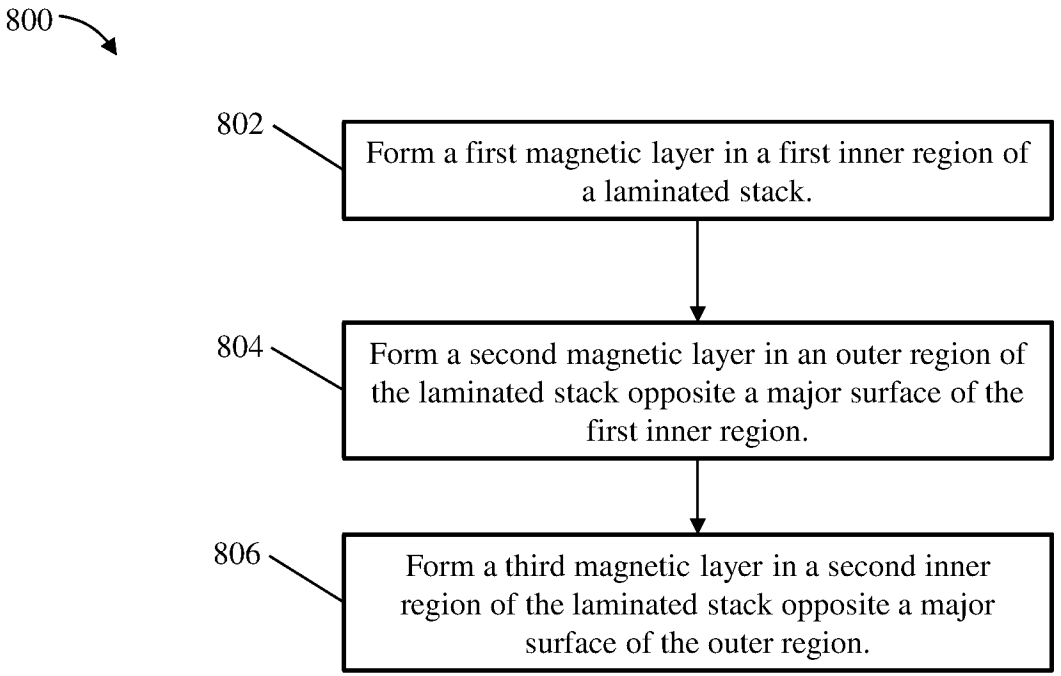
FIG. 8 depicts a flow diagram illustrating a method according to one or more embodiments of the invention.

FIG. 8 depicts a flow diagram illustrating a method according to one or more embodiments of the invention. As shown at block 802, a first magnetic layer is formed in a first inner region of a laminated stack. The first magnetic layer can be formed in a similar manner as the inner magnetic layer 202 (as depicted in FIG. 2) according to one or more embodiments.

As shown at block 804, a second magnetic layer is formed in an outer region of the laminated stack opposite a major surface of the first inner region. The second magnetic layer can be formed in a similar manner as the outer magnetic layer 302 (as depicted in FIG. 3) according to one or more embodiments.

As shown at block 806 a third magnetic layer is formed in a second inner region of the laminated stack opposite a major surface of the outer region. The third magnetic layer can be formed in a similar manner as the inner magnetic layer 402 (as depicted in FIG. 4) according to one or more embodiments.

As discussed previously herein, the laminated stack can be structured such that a thickness of the first and third magnetic layers is less than a thickness of the second magnetic layer. In this manner, eddy current losses can be controlled in critical regions (i.e., the first and second inner regions) while providing improved throughput in noncritical regions (i.e., the outer region).

Various embodiments of the present invention are described herein with reference to the related drawings. Alternative embodiments can be devised without departing from the scope of this invention. Although various connections and positional relationships (e.g., over, below, adjacent, etc.) are set forth between elements in the following description and in the drawings, persons skilled in the art will recognize that many of the positional relationships described herein are orientation-independent when the described functionality is maintained even though the orientation is changed. These connections and/or positional relationships, unless specified otherwise, can be direct or indirect, and the present invention is not intended to be limiting in this respect. Similarly, the term "coupled" and variations thereof describes having a communications path between two elements and does not imply a direct connection between the elements with no intervening elements/connections between them. All of these variations are considered a part of the specification. Accordingly, a coupling of entities can refer to either a direct or an indirect coupling, and a positional relationship between entities can be a direct or indirect positional relationship. As an example of an indirect positional relationship, references in the present description to forming layer "A" over layer "B" include situations in which one or more intermediate layers (e.g., layer "C") is between layer "A" and layer "B" as long as the relevant characteristics and functionalities of layer "A" and layer "B" are not substantially changed by the intermediate layer(s).

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection."

References in the specification to "one embodiment," "an embodiment," "an example embodiment," etc., indicate that the embodiment described can include a particular feature, structure, or characteristic, but every embodiment may or may not include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

For purposes of the description hereinafter, the terms "upper," "lower," "right," "left," "vertical," "horizontal," "top," "bottom," and derivatives thereof shall relate to the described structures and methods, as oriented in the drawing figures. The terms "overlying," "atop," "on top," "positioned on" or "positioned atop" mean that a first element, such as a first structure, is present on a second element, such as a second structure, wherein intervening elements such as an interface structure can be present between the first element and the second element. The term "direct contact" means that a first element, such as a first structure, and a second element, such as a second structure, are connected without any intermediary conducting, insulating or semiconductor layers at the interface of the two elements.

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

The phrase "selective to," such as, for example, "a first element selective to a second element," means that the first element can be etched and the second element can act as an etch stop.

The term "conformal" (e.g., a conformal layer) means that the thickness of the layer is substantially the same on all surfaces, or that the thickness variation is less than 15% of the nominal thickness of the layer.

The flowchart and block diagrams in the Figures illustrate possible implementations of fabrication and/or operation methods according to various embodiments of the present invention. Various functions/operations of the method are represented in the flow diagram by blocks. In some alternative implementations, the functions noted in the blocks can occur out of the order noted in the Figures. For example, two blocks shown in succession can, in fact, be executed substantially concurrently, or the blocks can sometimes be executed in the reverse order, depending upon the functionality involved.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A method of fabricating a laminated magnetic inductor, the method comprising:

forming a first magnetic stack comprising a plurality of magnetic layers alternating with a plurality of insulating layers in a first inner region of the laminated magnetic inductor;

forming a second magnetic stack comprising a plurality of magnetic layers alternating with a plurality of insulating layers opposite and extending in a first direction from a major surface of the first magnetic stack in an outer region of the laminated magnetic inductor; and forming a third magnetic stack comprising a plurality of magnetic layers alternating with a plurality of insulating layers opposite and extending in the first direction from a major surface of the second magnetic stack in a second inner region of the laminated magnetic inductor;

wherein a lateral thickness of each magnetic layer in the first inner region is less than a lateral thickness of each magnetic layer in the outer region, each lateral thickness measured in the first direction.

2. The method of claim 1, wherein the first magnetic stack is formed opposite a major surface of a substrate.

3. The method of claim 2 further comprising forming a first dielectric layer between the substrate and the first magnetic stack.

4. The method of claim 3 further comprising forming a second dielectric layer opposite a major surface of the third magnetic stack.

5. The method of claim 4 further comprising forming a conductive coil helically wrapping through the first and second dielectric layers.

6. The method of claim 3, wherein the plurality of magnetic layers in the first inner region are conformally deposited over the first dielectric layer.

7. The method of claim 3, wherein a thickness of the first magnetic layer in the first inner region is about 5 nm to about 100 nm.

8. The method of claim 7, wherein the insulating layers in the first magnetic stack comprise alumina ($Al_2O_3$).

9. The method of claim 7, wherein the insulating layers in the first magnetic stack comprise silicon dioxide ($SiO_2$).

10. The method of claim 7, wherein the insulating layers in the first magnetic stack comprise silicon nitride (SiN).

11. The method of claim 7, wherein the insulating layers in the first magnetic stack comprise silicon oxynitride (SiOxNy).

12. The method of claim 7, wherein the insulating layers in the first magnetic stack comprise magnesium oxide (MgO).

13. The method of claim 7, wherein the insulating layers in the first magnetic stack comprise a combination of alumina ($Al_2O_3$), silicon dioxide ($SiO_2$), silicon nitride, silicon oxynitride (SiOxNy), and magnesium oxide (MgO).

14. The method of claim 7, wherein the insulating layers in the first magnetic stack comprise a thickness of about 5 nm to about 10 nm.

15. The method of claim 7, wherein a magnetic layer in the outer region is conformally deposited over an insulating layer of the first inner region.

16. The method of claim 15, wherein a thickness of each of the plurality of magnetic layers in the outer region is about 200 nm to about 800 nm.

17. The method of claim 3 further comprising removing portions of the laminated magnetic inductor selective to the first dielectric layer.

18. The method of claim 17, wherein the first dielectric layer comprises a material selected from the group comprising silicon dioxide ($SiO_2$), silicon oxynitride (SiON), and silicon oxycarbonitride (SiOCN), and wherein the laminated magnetic inductor includes at least one layer comprising a magnetic material.

19. The method of claim 1, wherein the plurality of magnetic layers in the first magnetic stack comprise a cobalt (Co) containing compound, FeTaN, FeNi, FeAlO, or a combination thereof.

* * * * *